US005673548A

United States Patent [19]

Raasch et al.

[11] Patent Number: 5,673,548

[45] Date of Patent: Oct. 7, 1997

[54] SLIVER FEEDING DEVICES FOR OPEN-END SPINNING FRAMES

[75] Inventors: Hans Raasch; Heinz-Georg Wassenhoven, both of Mönchengladbach, Germany

[73] Assignee: W. Schlafhorst AG & Co., Moenchengladbach, Germany

[21] Appl. No.: 584,621

[22] Filed: Jan. 11, 1996

[30] Foreign Application Priority Data

Feb. 11, 1995 [DE] Germany ..... 195 04 607.2

[51] Int. Cl.[6] ..... D01H 4/30; D01H 4/32; D01H 4/38

[52] U.S. Cl. ..... 57/412; 57/408

[58] Field of Search ..... 57/412, 263, 408, 57/409, 410, 411, 413, 315

[56] References Cited

U.S. PATENT DOCUMENTS

| | | | |
|---|---|---|---|
| 4,254,612 | 3/1981 | Miyamoto et al. | 57/412 |
| 4,459,801 | 7/1984 | Stahlecker et al. | 57/412 |
| 4,590,757 | 5/1986 | Stahlecker | 57/412 |
| 4,660,371 | 4/1987 | Stalder | 57/412 |
| 4,815,269 | 3/1989 | Wassenhoven | 57/412 |
| 4,825,637 | 5/1989 | Wassenhoven | 57/412 |
| 4,926,627 | 5/1990 | Braun et al. | 57/412 |
| 4,976,099 | 12/1990 | Brockmanns et al. | 57/412 |
| 5,185,994 | 2/1993 | Stahlecker | 57/412 |
| 5,373,690 | 12/1994 | Gebhardt | 57/412 |
| 5,454,219 | 10/1995 | Raasch | 57/412 |

FOREIGN PATENT DOCUMENTS

| | | |
|---|---|---|
| 28 12 472 A1 | 9/1979 | Germany . |
| 41 01 315 A1 | 7/1992 | Germany . |
| 44-25154 | 10/1969 | Japan . |

*Primary Examiner*—Daniel P. Stodola
*Assistant Examiner*—Tina R. Taylor
*Attorney, Agent, or Firm*—Shefte, Pinckney & Sawyer

[57] ABSTRACT

A sliver feeding device for an open-end spinning frame, comprising a sliver draw-in roller and a sliver feed trough pivotable about a supporting shaft for movement toward and away from the draw-in roller. The draw-in roller has an annular sliver conveying collar which defines a sliver nip between the collar and the feed trough, and the feed trough has opposed laterally spaced bars for receiving the collar therebetween to guide the sliver at the nip. The draw-in roller is rotatably supported so as to permit a predetermined amount of axial movement of the collar between the guide bars of the feed trough. Similarly, a predetermined amount of axial movement of the feed trough is permitted on the supporting shaft. The collar has axial end faces each comprising a respective cleaning device. The guide bars of the feed trough have inwardly facing bevels which, in connection with the axial play of the feed trough on the supporting shaft, assure automatic pivoting of the feed trough into its operating position.

11 Claims, 2 Drawing Sheets

SLIVER FEEDING DEVICES FOR OPEN-END SPINNING FRAMES

FIELD OF THE INVENTION

The present invention relates to a sliver feeding device for an open-end spinning frame, utilizing a draw-in roller and a feed trough which can be placed against the draw-in roller, wherein the feed trough has lateral bars guiding the sliver in a nip line area.

BACKGROUND OF THE INVENTION

In sliver opening units, such as are used in connection with open-end spinning frames, it is customary to provide a cylindrical (preferably corrugated) draw-in roller and an associated feed trough to form a sliver nip area through which the draw-in roller directs the sliver to travel from a supply location in spinning cans to a downstream opening roller at a constant transport speed. As the sliver travels to the opening roller the sliver first moves through a condenser, which not only compresses the sliver but also forms it into a profile advantageous for being drawn into the nip area. As a result, the silver enters the nip formed by the draw-in cylinder and the feed trough with a desired cross section. Usually the nip area formed by the draw-in cylinder and the feed trough is considerably wider than the sliver, so that it is assured that the sliver continues to be securely gripped between the draw-in roller and the feed trough across the full width of the sliver despite the flattening action on the silver in the nip area. However, to prevent the sliver from being flattened or spread too wide across the downstream opening roller into its lateral end edge areas where the desired combing of the sliver is no longer provided, it has been proposed to dispose a fiber tuft support with lateral bars following the nip area, thereby to prevent the uncontrolled spreading of the sliver. Such a fiber tuft support which laterally guides the sliver is described in German Patent Publication DE 41 01 315 A.

It is also known to provide guide surfaces directly in the nip area of the sliver. Japanese Utility Model 44-25154 discloses a feed trough with lateral guide bars, between which a roller-like sliver advancing element rotates. Although such a device makes it possible to prevent spreading apart of the sliver to the greatest degree, so that relatively secure gripping is assured in the lateral areas of the sliver, the known device has important disadvantages, in particular in respect to its tendency to become soiled, which therefore have prevented the device from being acceptable in practical use.

OBJECT AND SUMMARY OF THE INVENTION

Based on the foregoing, it is an object of the present invention to provide an improved sliver feeding device for an open-end spinning frame, which avoids the disadvantages of the known devices described above.

This object is achieved in accordance with the present invention by a sliver feeding device basically comprising a sliver draw-in roller and a sliver feed trough pivotable about a supporting shaft for movement toward and away from the draw-in roller. The draw-in roller has an annular sliver conveying collar which defines a sliver nip between the collar and the feed trough, and the feed trough has opposed laterally spaced bars for receiving the collar therebetween to guide the sliver at the nip. The draw-in roller is rotatably supported so as to permit a predetermined amount of axial movement of the collar between the guide bars of the feed trough. Similarly, a predetermined amount of axial movement of the feed trough is permitted on the supporting shaft. The collar has axial end faces each comprising a respective cleaning device.

Because of the selected fit between the conveying collar and the feed trough, as well as the axial movement (or "play") of the pivotably seated feed trough on the supporting shaft, the feed trough automatically pivots into its operating position and securely rests against the conveying collar during the sliver feeding operation, whereby the incoming sliver is continuously gripped securely over its entire width. In addition, the cleaning devices at the end faces of the conveying collar prevent the deposit of fiber, dust, etc. between the bars of the feed trough, which over a period of time would result in considerable disruptions of the sliver feeding device and in improper sliver drafting results.

According to a further aspect of the invention, a central annular area of the peripheral surface of the conveying collar is corrugated leaving the annular peripheral edge areas of the surface uncorrugated thereby avoiding open outer edges of the corrugations which experience has shown are particularly sensitive to wear. In this manner, the service life of the device in accordance with the invention is considerably improved.

Advantageously, the corrugations comprise a plurality of individual grooves which are disposed axially of the collar to be orthogonal with respect to the sliver transport direction of the collar. At least at the opposite ends of each groove, the bottom of the groove is concavely curved. The grooves are disposed about the circumference of the conveying collar at an angular distance from one another of about 3% to 15%, preferably in the range of 6% to 7%. Such a design not only offers the advantage that it can be cost-effectively produced, a gentle treatment of the delicate sliver is also assured during sliver conveyance.

The cleaning devices in the area of the axial end faces of the conveying collar on the draw-in cylinder are preferably embodied as spirally arranged conveying grooves with the direction of the spiral of these conveying grooves being selected so as to impose a component of conveying movement in the direction toward the conveying collar surface when the draw-in cylinder rotates in the sliver conveying direction. In this manner, it is assured that fibers or dirt, which are enabled to enter this area because of the axial play preset between the conveying collar and the feed trough bars, are immediately removed in the direction toward the conveying collar surface.

In accordance with a further feature of the invention, the lateral bars of the feed trough have feeding slopes which are oriented inwardly, i.e. facing each other. The width of these feeding slopes has been selected such that they are wider than the amount of axial play of the feed trough on the supporting shaft. Such a design has the advantage that, after the feed trough has been pivoted open, for example for inserting a fresh sliver, the feed trough will be automatically guided back into the operational position when pivoted closed. Thus, after the feed trough has been pivoted open, no adjustments or the like are required for returning the feed trough into its operational position wherein its lateral bars extend over the conveying collar of the draw-in cylinder.

According to a further aspect of the invention, the sliver inlet surface is either level or has a concave curvature in the area of the sliver nip. In case of a concave curvature of the sliver inlet surface, the radius of the curvature is slightly greater than the radius of the contacting conveying collar. A feed trough embodied in this way offers the advantage, for example, that the nip of the device can be moved, if required, toward the front reversing edge of the feed trough by, for example, displacing the feed trough.

Further details of the invention will be apparent from an exemplary embodiment described below with reference to the accompanying drawings.

DETAILED DESCRIPTION OF THE PREFERRED EMBODIMENT

Figure 1:
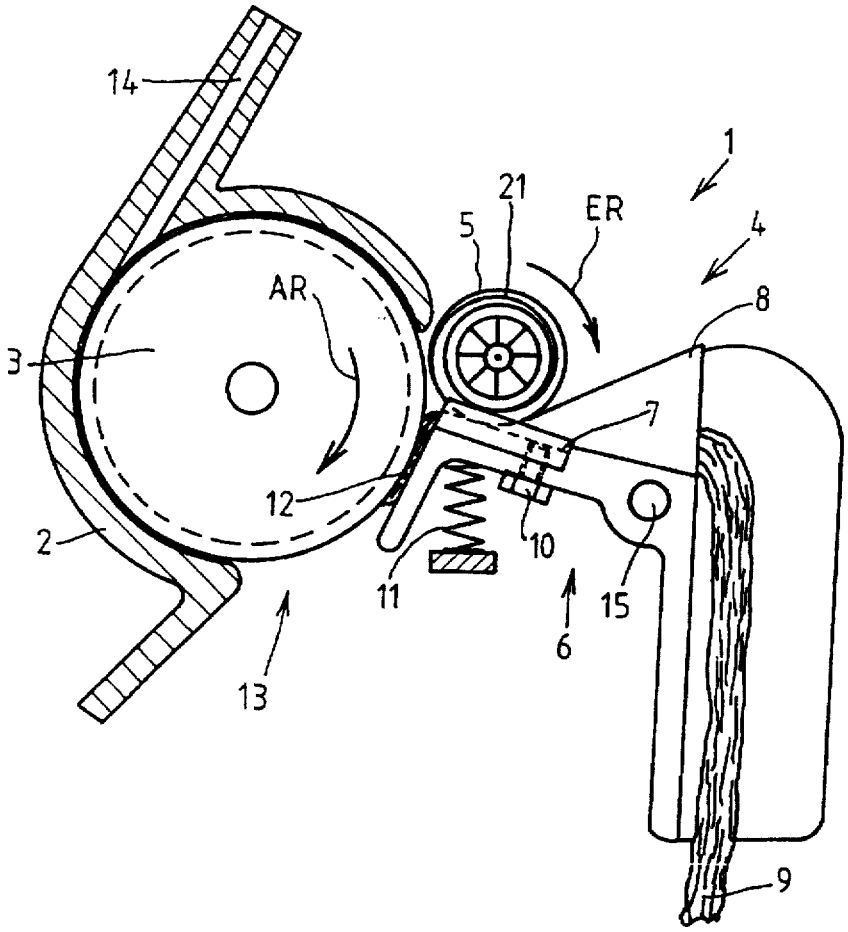
FIG. 1 is a front elevational view of a sliver opening unit with a sliver feeding device in accordance with a preferred embodiment of the present invention.

A sliver opening unit 1 is schematically illustrated in FIG. 1 and has a customary opening roller 3 rotating inside the opening roller housing 2. Such opening rollers typically have a sawtooth or needle set (not shown), for opening a sliver 9 into individual constituent fibers. The sliver 9, intermediately stored in spinning cans (not shown), is continuously presented to the opening roller 3 by means of a sliver feeding device 4.

Figure 2:
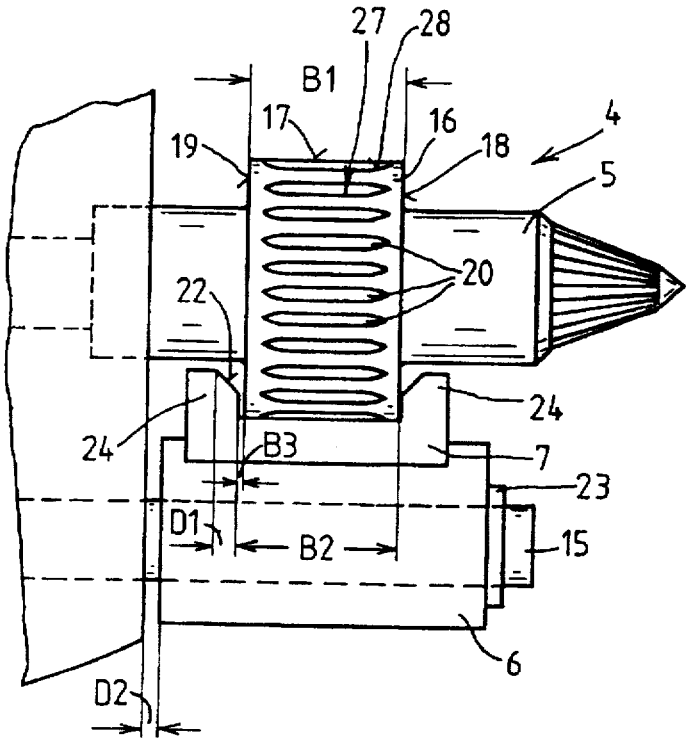
FIG. 2 is a side elevational view of the sliver feeding device of FIG. 1.

The sliver feeding device 4 basically comprises a draw-in cylinder 5 rotatable in the direction ER and a feed trough 7 fixed via a fastener 10 on a pivotably seated feed table 6 to be pivotable as a unit about a bearing shaft 15. As shown in FIG. 2, the feed trough 7 has a central sliver conveying surface bordered at the lateral sides thereof by opposed bars 24 defining a generally U-shape of the feed trough 7. During a spinning operation, the feed table 6 is acted upon in the direction toward the draw-in cylinder 5 by a spring element 11, whereby the feed trough 7 is operably urged against the draw-in cylinder 5. A sliver condenser 8 is integrated into the feed table 6 to guide the incoming sliver 9 to a nip area extending axially along the draw-in cylinder 5 between the draw-in cylinder 5 and the feed trough 7.

As can be seen in particular from FIG. 2, the draw-in cylinder 5 is encircled by an annular silver-conveying collar 16 having a corrugated area 27 extending annularly about its peripheral surface 17. This corrugated area 27 comprises a plurality of grooves 20, formed in the peripheral surface 17 axially with respect to the cylinder 5 at an angular circumferential distance from each other of about 30% to 150%, preferably in the range 6° to 7°, to be oriented orthogonally with respect to the sliver transport direction. The opposite axial ends of the grooves 20 terminate at a distance from the outer axial end faces 18, 19 of the conveying collar 16. Preferably, the bottom 28 of each groove is shaped to be concave, at least at the opposite groove ends.

The axial end faces 18, 19 of the conveying collar 16 are respectively provided with a cleaning device 21, which is preferably embodied as a spirally extending conveying groove 26. The direction of the spiral of the conveying groove 26 is selected such that sliver fibers or dirt in the area of the respective axial end face 18,19 will be transported in the direction TR toward the peripheral surface 17 by means of the groove when the draw-in cylinder 5 rotates in direction ER. As seen in FIG. 2, in the operating position of the feed trough 7, the peripheral surface of the conveying collar 16 on the draw-in cylinder 5 is received between the bars 24 of the feed trough 7. The width B1 of the conveying collar 16 is selected such that it can rotate with a predetermined degree of axial movement, or "play", B3 laterally between the bars 24 of the feed trough 7.

As already indicated above, the feed trough 7 is connected by the fastening means 10 to the feed table 6 which is held on a bearing shaft 15 by a retainer 23 for pivoting movement with a predetermined amount of axial movement or "play" D2. The outer bars 24 of the feed trough 7 are also provided with beveled surfaces 22 facing inwardly toward each other and of a lateral width D1. The width D1 of these beveled surfaces 22 is greater than the amount D2 of the axial play of the feed table 6 on the bearing shaft 15, thereby assuring that the feed trough 7 is automatically centered with respect to the draw-in cylinder 5 when being pivoted against the draw-in cylinder 5, i.e. The feed trough 7 automatically moves into the correct operational position.

Figure 3:
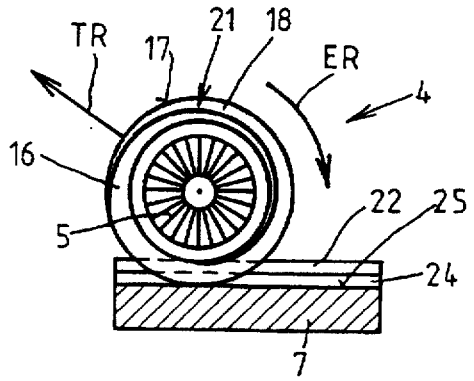
FIG. 3 is a front elevational view of a first embodiment of the feed trough of the sliver feeding device of the present invention.
Figure 4:
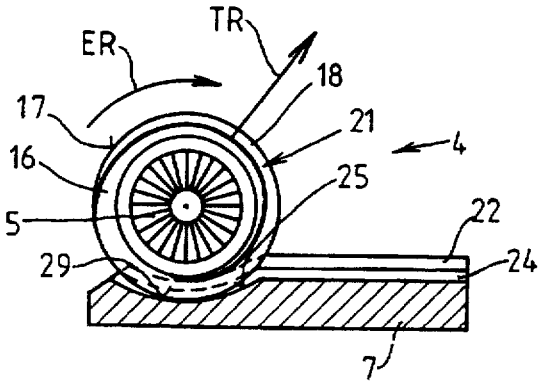
FIG. 4 is a front elevational view of an alternative embodiment of the feed trough of the sliver feeding device of the present invention.
Figure 5:
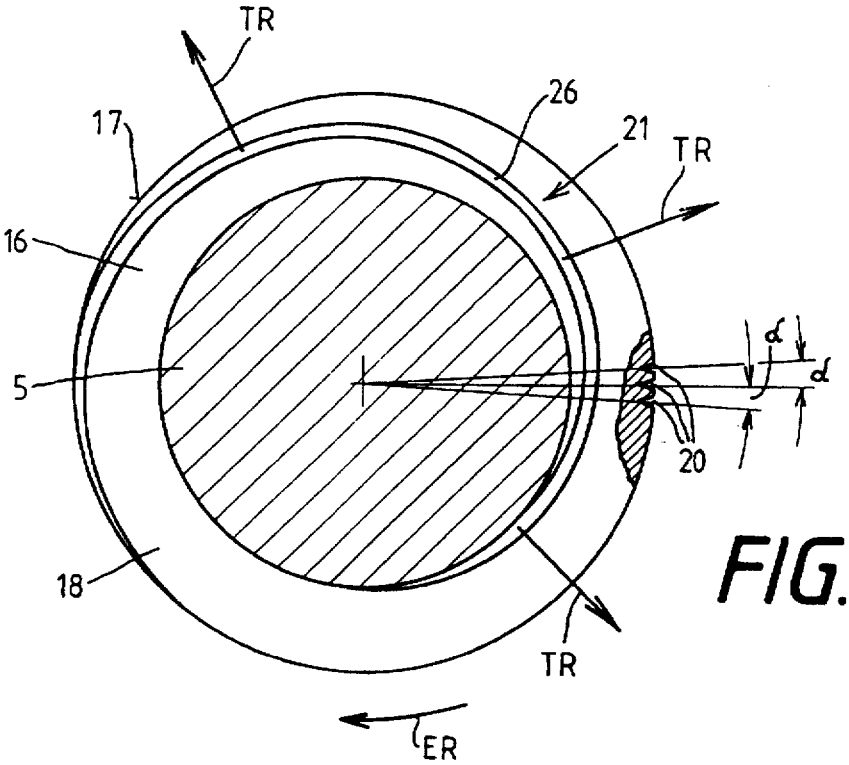
FIG. 5 is a front elevational view on an enlarged scale of a cleaning device disposed in the area of the axial end face of the draw-in cylinder collar.

As indicated in FIGS. 3 and 4, the feed trough 7 is either formed with a flat sliver inlet surface 25, as indicated in FIG. 3, or the sliver inlet surface 29 is embodied to be concave in the area of the draw-in cylinder 5, as indicated in FIG. 4. In the latter case the radius of the concave depression is slightly greater than the radius of the conveying collar 16 of the draw-in cylinder, so that the nip line between the draw-in cylinder and the feed trough can be moved by displacing the feed trough in the horizontal plane.

As a whole, the sliver feeding device 4 in accordance with the present invention represents a functionally correct, easy-to-operate device which assures that during the spinning process the opening roller is continuously provided with a gently treated, evenly gripped sliver.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A sliver feeding device for an open-end spinning frame, comprising a sliver draw-in roller and a sliver feed trough pivotable about a supporting shaft for movement toward and away from the draw-in roller, the draw-in roller having an annular sliver conveying collar having an annular surface defining a sliver nip between the collar and the feed trough, the feed trough having opposed laterally spaced bars for receiving the collar therebetween to guide the sliver at the nip, means for supporting the draw-in roller for rotation and for permitting a predetermined amount of axial movement of the collar between the guide bars of the feed trough, means for permitting a predetermined amount of axial movement of the feed trough on the supporting shaft, the collar having axial end faces each comprising a groove therein forming a respective cleaning device for conveying sliver away from the respective end face.

2. A sliver feeding device in accordance with claim 1, wherein the annular conveying collar surface comprises a corrugated surface centrally thereabout and opposed uncorrugated annular edge areas axially outwardly adjacent the corrugated surface.

3. A sliver feeding device in accordance with claim 1, wherein the corrugated surface comprises a plurality of grooves formed axially with respect to the collar.

4. A sliver feeding device in accordance with claim 3, wherein each groove has a groove bottom of a concave shape at opposite ends thereof.

5. A sliver feeding device in accordance with claim 3, wherein the grooves are spaced from one another circumferentially about the collar by an angular distance of between about 3° and 15°.

6. A sliver feeding device in accordance with claim 1, wherein each cleaning device comprises a spiral groove formed in the respective end face of the collar.

7. A sliver feeding device in accordance with claim 6, wherein each of the spiral grooves is formed relative to a sliver conveying direction of rotation of the collar to impose a conveying movement on debris at the respective end face of the collar toward the annular surface of the collar.

8. A sliver feeding device in accordance with claim 1, wherein the lateral bars of the feed trough have inwardly facing bevels of a predetermined lateral width.

9. A sliver feeding device in accordance with claim 8, wherein the width of the bevels is greater than the amount of permitted axial movement of the feed trough with respect to the supporting shaft.

10. A sliver feeding device in accordance with claim 1, wherein the feed trough has a flat sliver inlet surface.

11. A sliver feeding device in accordance with claim 1, wherein the feed trough has a concave sliver inlet surface.

* * * * *